US006145518A

United States Patent [19]

Huffman

[11] Patent Number: 6,145,518

[45] Date of Patent: Nov. 14, 2000

[54] BULK ULTRASONIC DEGREASING CLEANING AND DRYING APPARATUS AND METHOD OF USING SAME

[75] Inventor: Stanley S. Huffman, Solana Beach, Calif.

[73] Assignee: CRS Holdings, Inc., Wilmington, Del.

[21] Appl. No.: 09/218,185

[22] Filed: Dec. 22, 1998

Related U.S. Application Data

[60] Provisional application No. 60/070,210, Dec. 31, 1997.

[51] Int. Cl.[7] ..... B08B 3/12

[52] U.S. Cl. ..... 134/61; 134/105; 134/184

[58] Field of Search ..... 134/1, 61, 66, 134/76, 77, 83, 89, 90, 105, 107, 108, 184, 186

[56] References Cited

U.S. PATENT DOCUMENTS

| | | | |
|---|---|---|---|
| 2,834,359 | 5/1958 | Kearney . | |
| 3,001,769 | 9/1961 | Plassmeyer | 134/1 X |
| 3,229,702 | 1/1966 | Murdoch, Jr. . | |
| 4,379,724 | 4/1983 | Kashiwagi . | |
| 4,788,992 | 12/1988 | Swainbank et al. . | |
| 5,067,983 | 11/1991 | Uchino | 134/1 |
| 5,201,958 | 4/1993 | Breunsbach et al. . | |
| 5,218,980 | 6/1993 | Evans . | |
| 5,240,506 | 8/1993 | Liers et al. . | |
| 5,378,287 | 1/1995 | Pedziwiatr . | |
| 5,409,594 | 4/1995 | Al-Jiboory et al. . | |
| 5,494,063 | 2/1996 | Suzuki et al. | 134/61 |
| 5,501,240 | 3/1996 | Dohku et al. | 134/61 |
| 5,503,681 | 4/1996 | Inada et al. | 134/1 |

*Primary Examiner*—Philip R. Coe

*Attorney, Agent, or Firm*—Dann, Dorfman, Herrell and Skillman, P.C.

[57] ABSTRACT

A system and method for removing a coating from an elongated metal part or a bundle of such parts is described. The disclosed system includes a soaking vessel that contains a solution suitable for degreasing the metal part and softening the coating thereon. An ultrasonic cleaning vessel containing an aqueous cleaning solution cleans the coating off of the metal part by ultrasonic agitation. The system further includes at least one rinsing vessel for rinsing the cleaning solution of the cleaned part, and a drying vessel for rapidly and thoroughly drying the part after it has been rinsed. In the disclosed process, the elongated metal part, or a bundle of such parts, is/are soaked in a solution that is maintained at an elevated temperature for a time sufficient to soften the coating. The elongated metal part is then subjected to ultrasonic agitation in an aqueous cleaning solution bath at an elevated temperature for a time sufficient to loosen and dislodge the coating from the elongated metal part. The elongated metal part is then rinsed to remove any residue and rapidly dried.

10 Claims, 6 Drawing Sheets

BULK ULTRASONIC DEGREASING CLEANING AND DRYING APPARATUS AND METHOD OF USING SAME

This application claims the benefit of U.S. Provisional Application No. 60/070,210, filed Dec. 31, 1997.

FIELD OF THE INVENTION

This invention relates to an ultrasonic cleaning apparatus and in particular to such an apparatus and a method of using same for the bulk cleaning of a chlorinated drawing compound from an elongated metallic object such as tubing or wire, with only a minimal amount of non-aqueous cleaning agent.

BACKGROUND OF THE INVENTION

Certain elongated steel parts, such as small diameter tubes, are cold worked to precision tolerances by a process known as drawing. The drawing process involves pulling the elongated part through a die or series of drawings dies wherein its diameter is reduced to a desired dimension. In order to facilitate the drawing process, the parts are coated with a lubricant to prevent binding and wear in the drawing die. Because many drawing lubricants do not adhere well to the metal surface of the parts to be drawn, it is sometimes necessary to apply a coating to the surface of the steel part which acts as a carrier for the drawing lubricant. One such coating is chlorinated rubber and another is chlorinated paraffin. Such compounds are applied to the metal parts in solution form using an aromatic hydrocarbon solvent such as toluene. The chlorinated rubber or chlorinated paraffin coatings adhere tenaciously to the surface of the metal parts and must be removed after the drawing process is completed.

Hitherto, a chlorinated solvent such as trichloroethylene (TCE) was used to remove the chlorinated rubber and chlorinated paraffin coatings from the elongated metal parts. Chlorinated solvents such as TCE are highly toxic are very difficult to dispose of in an environmentally safe manner. Consequently, it has become highly desirable to have an environmentally safe and easy to use method for cleaning chlorinated rubber or chlorinated paraffin coatings from elongated metal parts after they have been drawn to a desired size. Moreover, since such parts are usually handled in bundles, any such process should be capable of performing such cleaning on a substantial number of pieces in bundles.

SUMMARY OF THE INVENTION

In accordance with one aspect of this invention, there is provided a system for removing a coating from an elongated metal part or a bundle of such parts. The system according to this aspect of the invention includes a soaking vessel that contains a solution suitable for degreasing and softening the coating on the metal part. The system also includes an ultrasonic cleaning vessel containing an aqueous cleaning solution for effectively cleaning the coating off of the metal part by ultrasonic agitation. The system further includes at least one rinsing vessel for rinsing the cleaning solution of the cleaned part, and a drying vessel for rapidly and thoroughly drying the part after it has been rinsed.

In accordance with another aspect of this invention, there is provided a method for removing a coating from the surface of an elongated metal part. In the process according to this invention, the elongated metal part, or a bundle of such parts are first soaked in a solution that is maintained at an elevated temperature for a time sufficient to soften the coating. The elongated metal part is then immersed in an aqueous cleaning solution bath at an elevated temperature. The cleaning solution bath is agitated, preferably by ultrasonic vibration, for a time sufficient to loosen and dislodge the coating from the elongated metal part. The elongated metal part is then rinsed to remove any residue and rapidly dried.

BRIEF DESCRIPTION OF TIE DRAWINGS

The following detailed description of a preferred embodiment of the present invention will be better understood when read in conjunction with the appended drawings, wherein.

DESCRIPTION OF A PREFERRED EMBODIMENT

The bulk degreasing and cleaning apparatus according to the present invention, and the associated process of operating same, utilizes a unique combination of components and steps, respectively, including ultrasonic energy, to provide enhanced cleaning of small diameter tubes in bulk form with a minimum amount of non-aqueous solvent. The system and method of the present invention includes processing the parts in two cleaning solutions followed by a rough rinse in hot deionized water, a final rinse in hot deionized water, and a forced air dry.

Figure 1:
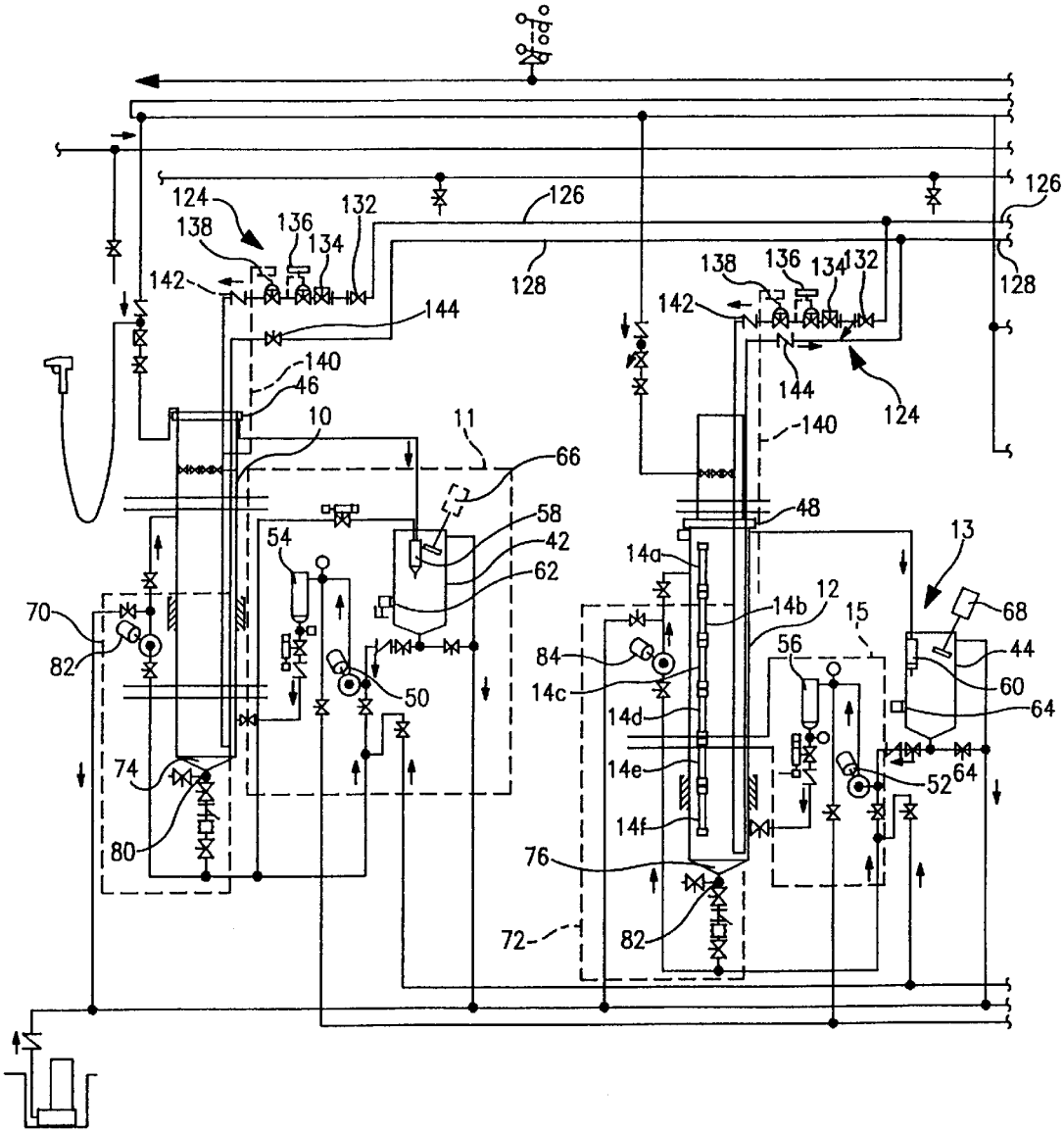
FIG. 1 is a schematic diagram of a first stage of a bulk degreasing and ultrasonic cleaning system including a presoak tank and an ultrasonic cleaning tank in accordance with the present invention.
Figure 2:
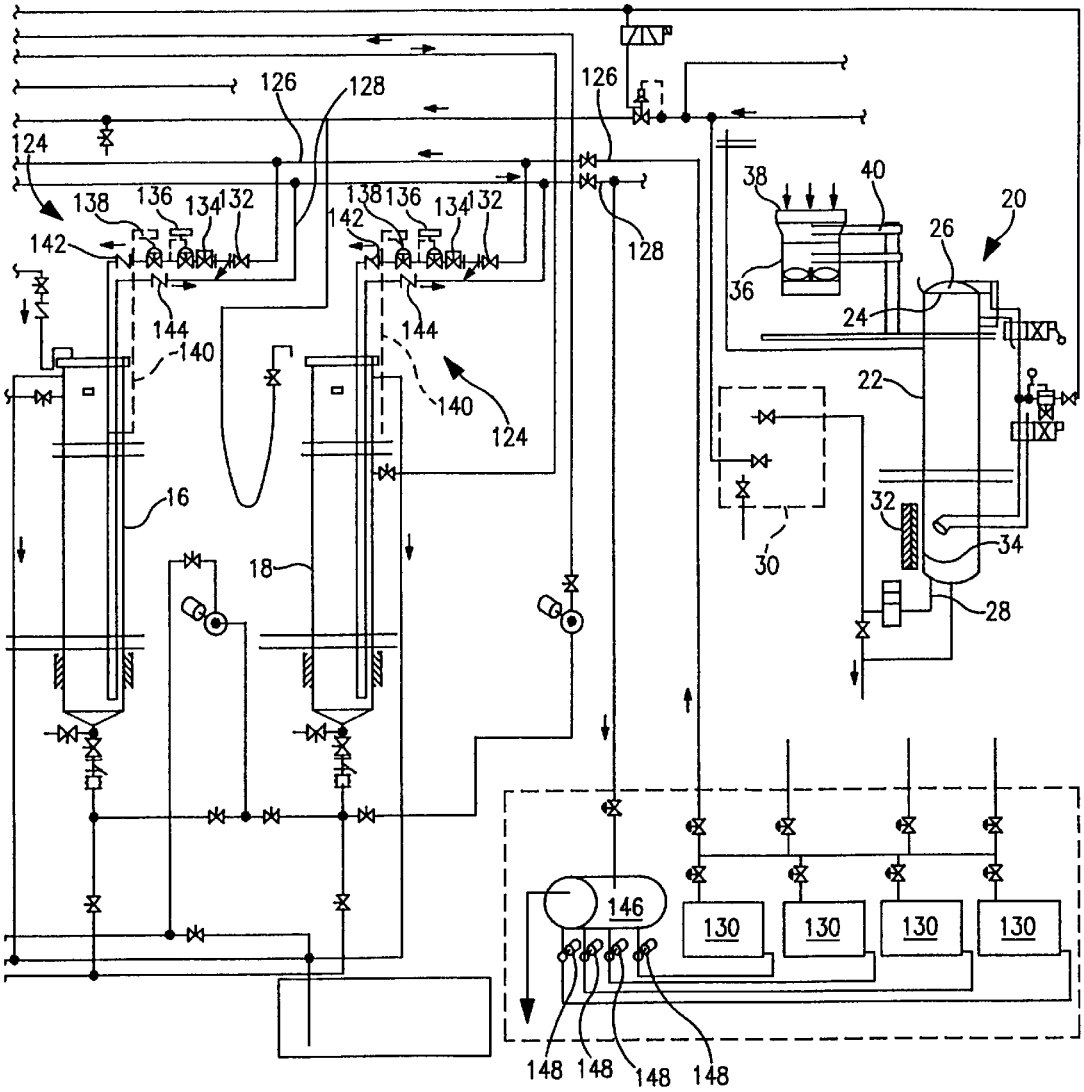
FIG. 2 is a schematic diagram of a second stage of the system of FIG. 1 including rinse tanks and a dryer.

Referring now to FIGS. 1 and 2, there shown schematically a system in accordance with the present invention. A presoak tank 10 contains a semi-aqueous solution of a degreaser and softener which is maintained at an elevated temperature. A preferred degreaser/softener is terpene solution. The parts are immersed in the semi-aqueous solution for a time sufficient to loosen surface soils and to soften any coating on the tubes that contains chlorinated rubber and/or chlorinated paraffin. The presoak tank 10 has a heating loop 124 for heating and maintaining the degreasing/softening solution at the elevated temperature, preferably about 150–200° F. The heating loop 124 includes a plurality of boilers 130, a feed line 126, a return line 128, and a condensate collection tank 146.

The boilers 130 heat water into steam which travels through feed line 126 to the presoak tank 10. A shut-off valve 132, solenoid valve 134, regulator valve 136, temperature control valve 138, and check valve 142 are provided to control and regulate the supply of steam to the presoak tank. The regulator 136 regulates the steam pressure from about 70 psi to about 30 psi. The temperature control valve 138 is provided in the feed line 126 for automatically controlling the flow of steam into the presoak tank and thereby to control the temperature of the degreaser/softener solution. A temperature bulb 140 is disposed inside the presoak tank 10 to sense the temperature of the degreasing/softening solution and is operatively connected to the temperature control valve 138. When the temperature bulb 140 senses that the temperature of the degreasing/softening solution is above the desired temperature, it sends a signal to the control valve 138 to close, thereby prohibiting steam from entering the presoak tank 10. When temperature bulb 140 senses that the temperature of the degreasing/softening solution is below the desired temperature, it sends an appropriate signal to the temperature control valve 138 to open, thereby allow steam to pass enter the presoak tank 10. The heat from the steam in the feed line 126 extending in the presoak tank 10 passes to the degreasing/softening solution, thereby raising its temperature. As the heat from the steam is transferred to the degreasing/softening solution the steam condenses into water. The condensation passes through a check valve 144, travels through the return line 128, and is collected in a condensate collection tank 146. The condensate in tank 146 is pumped back into the boilers 130 by a series of pumps 148.

Identical heating loop arrangements are provided at the ultrasonic cleaning tank 12, the rough rinse tank 16, and the final rinse tank 18 to heat the fluids used in those devices during operation of the system.

The presoak tank 10 has an overflow recirculation filtering system 11 for removing the loosened soil from the degreasing/softening solution. The overflow recirculation filtering system 11 includes an overflow tank 42, a pump 50, and a fine filter 54. As the presoak tank 10 is filled with degreasing/softening solution, a catch basin 46 at the top of the presoak tank 10 will fill and begin to overflow. The overflowing degreasing/softening solution passes through a coarse filter 58 located in the overflow tank 42. The coarse filter 58 removes the larger pieces of loosened soil from the degreasing/softening solution. The pump 50 draws the degreasing/softening solution and unfiltered loosened soil out of the overflow tank 42 and pumps it through the fine filter 54 where the remaining pieces of loosened soil are filtered out of the solution. A level switch 62 is located inside the overflow tank 42 for sensing the level of the solution in the overflow tank 42. When the level switch 62 senses that the level of the solution is too low, it operates to turn off pump 50 to prevent cavitation and possible destruction of the pump 50. After the degreasing/softening solution and loosened soil is passed through the fine filter 54, the filtered solution is injected back into the presoak tank 10.

In an alternative embodiment, a mixer 66 is provided in the overflow tank 42 for mixing a powder form of the degreaser/softener with water to form a liquid degreasing/softening solution. No mixer is required for the preferred degreaser/softener, terpene solution, because it can be purchased as a liquid.

The presoak tank 10 has an unfiltered recirculation system 70 for maintaining the homogeneity of the degreasing/softening solution and the uniformity of its temperature. A valve 80 at the bottom 74 of the presoak tank 10 is opened to drain the degreasing/softening solution from the presoak tank 10. A recirculation pump 82 draws the solution from the bottom 74 of the presoak tank 10 and injects the solution back into the presoak tank 10. The constant recirculation of the solution keeps the solution homogeneous and at a uniform temperature.

The ultrasonic cleaning tank 12 contains a heated sodium hydroxide based solution and is equipped with submersible ultrasonic transducers 14*a*–14*f* which provide agitation of the sodium hydroxide based solution to assist in cleaning the parts. The ultrasonic cleaning tank 12 has an overflow recirculation filtering system 15 for removing particles of loosened soil and coating from the sodium hydroxide based solution. The overflow recirculation filter system 15 includes an overflow tank 44, a pump 52, and a fine filter 56. As the cleaning tank 12 is filled with the cleaning solution, a catch basin 48 at the top of the cleaning tank 12 will fill and begin to overflow. The overflowing cleaning solution passes through a coarse filter 60 located in the overflow tank 44. The coarse filter 60 removes the larger pieces of loosened soil and coating particles from the cleaning solution. The pump 52 draws the cleaning solution and unfiltered soil and coating particles out of the overflow tank 44 and pumps it through the fine filter 56 where the remaining pieces of loosened soil and coating are filtered out. A level switch 64 is located inside the overflow tank 44 for sensing the level of the solution in the overflow tank 44. When the level switch 64 senses that the level of the cleaning solution is too low, it operates to turn off pump 52 to prevent cavitation and possible destruction of the pump. After the cleaning solution and loosened soil and coating particles are passed through the fine filter 56, the filtered solution is injected back into the cleaning tank 12.

A mixer 68 is provided in the overflow tank 44 to mix a powder with water to form the cleaning solution. The preferred sodium hydroxide based cleaning solution comes in a powder form that must be mixed with water to form a liquid cleaning solution.

The ultrasonic cleaning tank 12 has an unfiltered recirculation system 72 for maintaining the homogeneity of the sodium hydroxide based cleaning solution and the uniformity of its temperature. A valve 82 at the bottom 76 of the cleaning tank 12 is opened to drain the cleaning solution from the cleaning tank 12. A recirculation pump 84 draws the solution from the bottom 76 of the cleaning tank 10 and injects the solution back into the cleaning tank 12. The constant recirculation of the cleaning solution keeps the solution homogeneous and at a uniform temperature.

The application of ultrasonics for cleaning small diameter tubes in lengths of up to 30 feet or more, in bulk bundles is not standard. The problem is how to expose the interior and exterior surfaces along the entire length of the parts to the ultrasonic energy. The approach that is used in the present invention is full tank insonification. The transducers generate a homogeneous sound field encircling the transducer which creates a sufficient vibration density throughout the entire tank.

Figure 3:
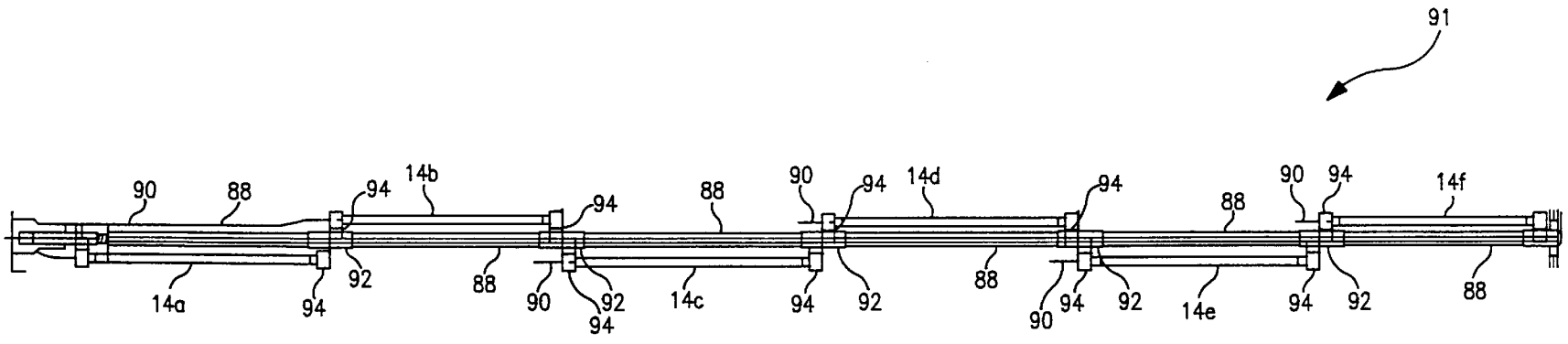
FIG. 3 is a front elevational view of an support structure for a set of ultrasonic transducers used in system according to the present invention.

Referring now to FIG. 3, submersible transducers 14*a*, 14*b*, 14*c*, 14*d*, 14*e*, and 14*f* are mounted on a support pipe 88 that is removably installed inside the ultrasonic cleaning tank 12. That arrangement facilitates installation, handling, and maintenance of the transducers. The ultrasonic transducers 14*a*–14*f* are disposed lengthwise, end-to-end in the ultrasonic cleaning tank 12 on alternate sides of the support pipe 88. Thus, transducers 14*a*, 14*c*, and 14*e* are aligned on one side of pipe 88 and transducers 14*b*, 14*d*, and 14*f* are aligned on the opposite side of the bar. Transducer supports 91 are provided for mounting the transducers 14*a*–14*f* on the support pipe 88.

Figure 6:
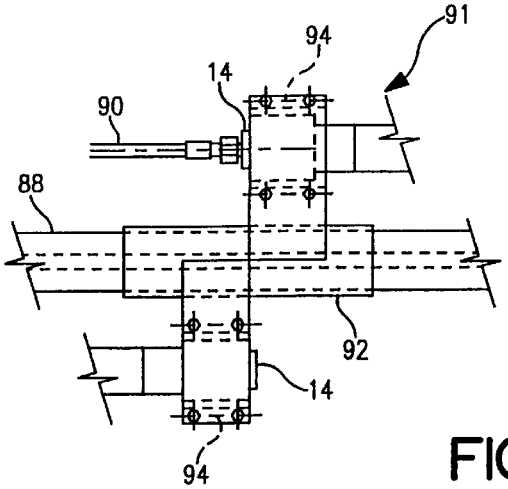
FIG. 6 is a detail view of a transducer support used for mounting the ultrasonic transducers on the support pipe of FIG. 3.

As shown in FIG. 6, the transducer support 91 includes a tubular sleeve 92 and wing plates 94*a*, 94*b*. The sleeves 92 are welded at selected locations on the support pipe 88. The wing plates 94*a*, 94*b* are welded onto opposite sides of the tubular sleeve 92. The transducers are mounted to the wing plates 94*a*, 94*b*. Electrical cables 90 for connecting the transducers to an electrical power source are connected to the tops of the transducers by any suitable connector. The cables 90 run along the length of the support pipe 88 and extend outside of the ultrasonic cleaning tank 12.

Figure 4:
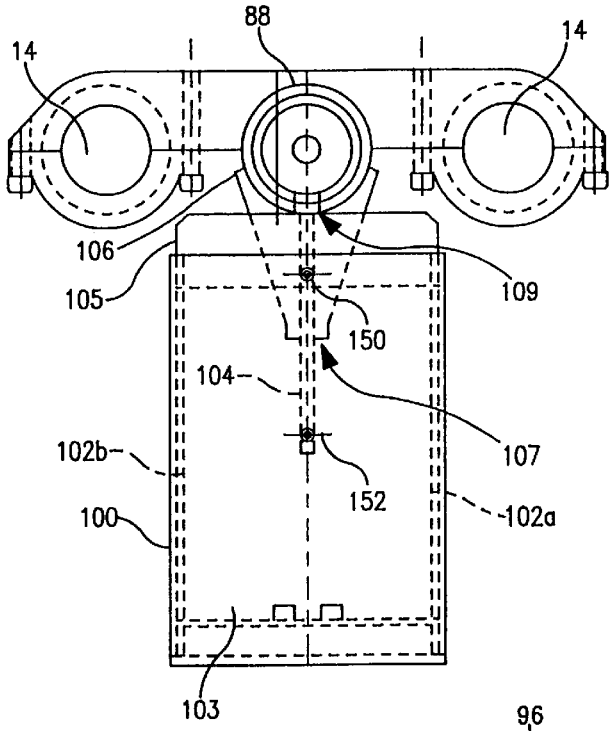
FIG. 4 is top plan view of a retaining bracket for suspending the support structure shown in FIG. 3 inside the ultrasonic cleaning tank shown in FIG. 1.
Figure 5:
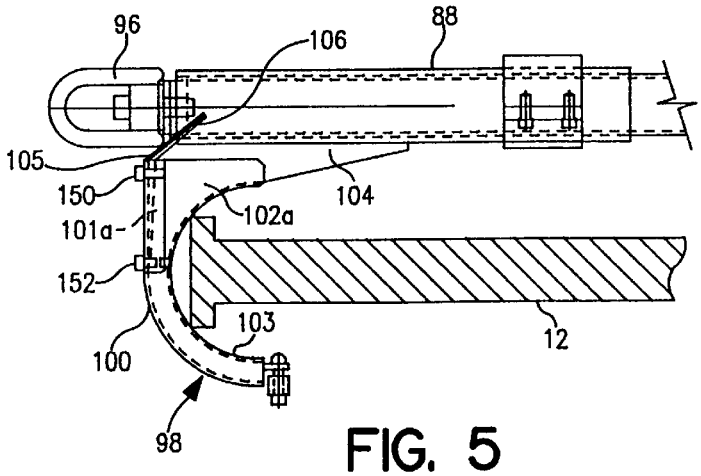
FIG. 5 is a side elevational view, in partial section showing further details of the retaining bracket of FIG. 4.

Referring now to FIGS. 4 and 5, a retaining bracket 98 is affixed to the upper end of the support pipe 88 and provides a means for suspending the pipe 88 on the edge of the ultrasonic cleaning tank 12. The retaining bracket 98 includes a top plate 100, a bottom plate 103, two side plates 102 *a*, 102*b*, a vertical support plate 104, and an angle member 106.

The top plate 100 of the retaining bracket 98 has a planar portion 97, a curved portion 99, and two tab portions 101*a*, 101*b*, one located on each side of bracket 98. The tab portions 101*a*, 101*b* are bent at a ninety degree angle relative to the planar portion 97 of bracket 98. Tab portion 101*b* is not shown in the drawing. The top plate 100 has an extending portion 105 that is bent at an angle relative to the planar portion 97. The two side plates 102*a*, 102*b* are generally U-shaped and are welded to the tab portions 101*a*, 101*b*, respectively. An angle member 106 that is generally V-shaped has a notch 107 formed at one end thereof and a cutout portion 109 at its other end. The angle member 106 is welded to the support pipe 88 and to the top plate 100. The angle member 106 acts as a stiffener for the retaining bracket 98 and stabilizes the retaining bracket 98 from twisting about the support pipe 88.

The bottom plate 103 is generally U-shaped and is welded to the side plates 102 *a*, 102*b* to form a channel therebetween with the top plate 100. The vertical support plate 104 is bolted to the planar portion 97 of the top plate 100 with bolts 150, 152 and divides the channel into two equal portions. The long edge of the vertical plate 104 is welded to the support pipe 88 and serves to attach the retaining bracket 98 to the support pipe 88. A portion the vertical plate 104 passes through the notch 107 of the V-shaped angle member 106.

The assembled retaining bracket 98 rests on the edge of the ultrasonic cleaning tank 12 as shown in FIG. 5. In order to place the cables 90 in the retaining bracket 98, bolts 150, 152 are loosened and the top plate 100 is removed. The cables are then placed inside the retaining bracket 98, the top plate is put back in place, and bolts 150, 152 are tightened. The cables 90 are divided by the vertical plate 104 inside of the retaining bracket 98. Thus, the cables for transducers 14*a*, 14*c*, and 14*e* are placed one side the channel inside the bracket 98 and the cables for transducers 14*b*, 14*d*, and 14*f* are placed on the other side of the channel inside the retaining bracket 98. In this manner, the cables 90 are effectively protected from damage when the retaining bracket 98 is resting on the edge of the ultrasonic cleaning tank 12. A hoisting ring 96 is provided on the end of the support pipe 88 so that the support pipe 88 can be lifted out of the tank 12 with the transducers 14*a–f* and cables 90 attached.

Referring now to FIG. 2, the rinsing tanks 16 and 18 are provided for rinsing the parts after the ultrasonic cleaning step. The rinsing tanks 16 and 18 contain deionized water at an elevated temperature, preferably about 150–200° F. The presoak tank 10, ultrasonic cleaning tank 12, and rinsing tanks 16 and 18 are constructed and dimensioned to receive a bundle of elongated tubes.

A dryer 20 includes a vessel 22 that is constructed and dimensioned to receive the bundle of elongated tubes. Dryer 20 has an opening 24 at one end and a hatch 26 associated therewith for closing off the vessel 22 after a load of tubes has been placed in the vessel. A steam inlet 28 is disposed at the opposite end of vessel 22. The steam inlet 28 is connected to a source of deionized steam, such as boiler 30. A damper 32 is mounted over a second opening 34 in the side of vessel 22. Damper 32 is connected to a source of air for pneumatically operating the damper to open or close. A high velocity blower 36, including an intake filter 38, is mounted on a pivotable support 40. The support 40 is constructed and located such that the blower 36 can be removably positioned over the opening 24 in vessel 22.

Figure 7:
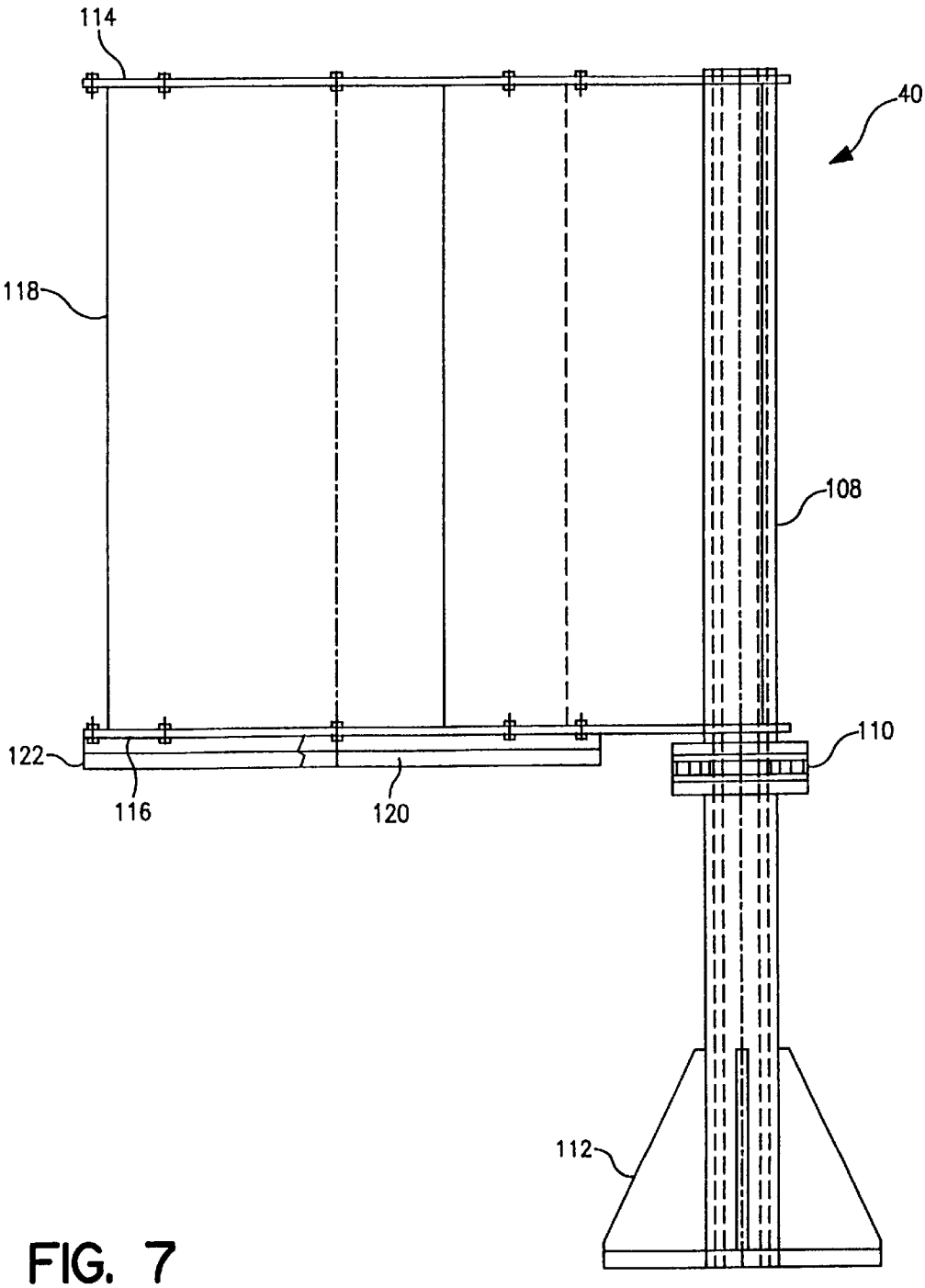
FIG. 7 is a side elevational view of a pivotable support and housing for a blower and an intake filter.

Referring now to FIG. 7, the pivotable blower support 40 includes a swivel post 108, a thrust bearing 110, and a base 112. An upper support flange 114 and a lower support flange 116 extend from the swivel post 108 for supporting a housing 118 for the blower 36. An intake filter (not shown) is disposed inside the housing 118. The thrust bearing 110 bears the load of the blower 36, housing 118, and intake filter and permits the blower 36 to be easily rotated into and out of position over the opening 24 of the drying vessel 22.

Figure 8:
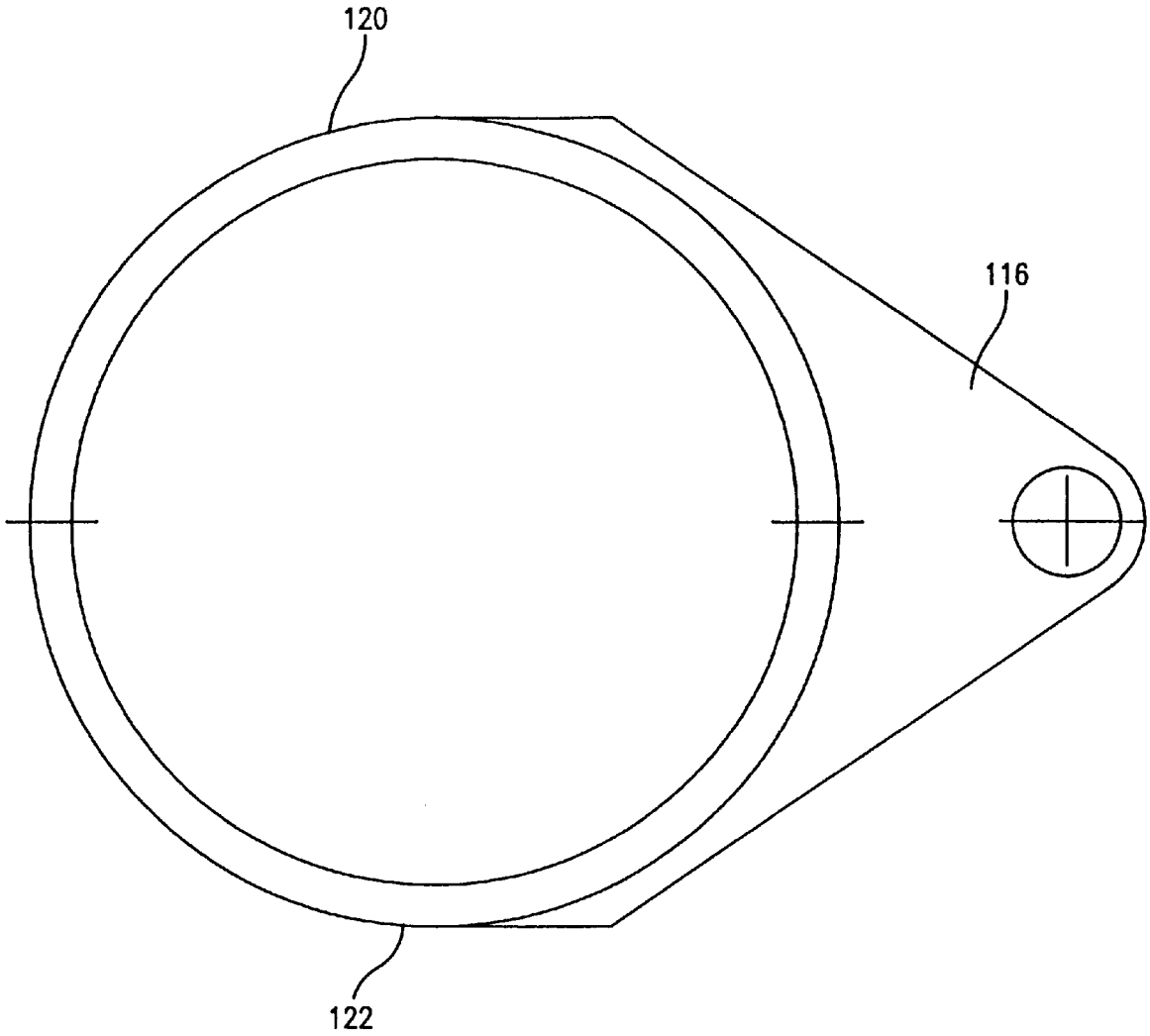
FIG. 8 is a bottom plan view of the housing shown in FIG. 7.

The lower support flange 116 has a seal to prevent leakage of air between the blower 36 and the opening 24 in vessel 22 when the blower 36 is positioned over the vessel 22. As shown in FIG. 8, the seal includes an inflexible metal seal 120 and a flexible seal 122. The flexible seal 122 is disposed about the leading edge of the flange 116 so that when the blower 36 is moved into position over the opening 24, the flexible seal 122 flexes as it passes over the lip or flange of the opening 24. When the blower 36 is fully in place over the drying vessel 22, the flexible seal 122 returns to its original shape to close off part of the gap between the drying vessel flange and the flange 116. In addition to sealing the remainder of the gap between the drying vessel and the flange 116, the inflexible metal seal 120 butts against the outside rim of the vessel 22 and, because of its rigidity, acts as a stop to prevent the pivotable support 40 from rotating further.

The following is a description of how the equipment is operated in accordance with the method of the present invention, with reference to FIGS. 1 and 2. A load is immersed and soaked in the presoak tank 10 containing the degreaser/softener solution for at least about 15 minutes. During the presoaking step, the degreaser/softener solution temperature is maintained at the elevated temperature. When the presoak time is complete, the load is transferred to the ultrasonic cleaning tank 12. The load is subjected to ultrasonic cleaning in the sodium hydroxide based solution for at least about 15 minutes. The overflow recirculation system 13 flushes the loosened soil and coating away and traps it in the filtering system 15. During the ultrasonic cleaning step, the sodium hydroxide based solution is maintained at an elevated temperature of about 150–200° F. At the end of the ultrasonic cleaning step, the load is spray rinsed with hot deionized water as the load is withdrawn from the ultrasonic cleaning tank 12. The load is then transferred into the rough rinse tank 16.

The parts load is rough rinsed by soaking it in the heated deionized water for at least about 15 minutes. The temperature of the deionized rinse water is maintained at the elevated temperature and the tank is continuously overflowed during the rough rinse. After the rough rinse step, the load is transferred to the final rinse tank 18. The load is given a final rinse by soaking in deionized water for at least about 15 minutes. During the final rinse, the deionized water is maintained at the elevated temperature and the tank is continuously overflowed.

After the final rinse, the load is transferred into the dryer 20 and hatch 26 is closed. Live deionized steam is injected into the dryer 20 and applied to the parts load directly. The steam heats the parts and when the parts reach the desired elevated temperature, preferably about 180° F., the steam is turned off. The damper 32 and the hatch 26 are opened. The blower 36 is swung into position over opening 22 and air is directed over the heated parts at high velocity. The heated parts flash the deionized rinse water to vapor and the high velocity air cools the parts and evacuates the water vapor through damper 32. The application of the forced air in the drying tank is carried out for at least about 15 minutes, until the load is completely dry. The load is then checked to be sure that it is completely dry, particularly inside the tubes before it is processed further.

It will be recognized by those skilled in the art that changes or modifications may be made to the above-described embodiments without departing from the broad inventive concept of the invention. It should therefore be understood that this invention is not limited to the particular embodiments described herein but is intended to include all changes and modifications that are within the scope and spirit of the invention as set forth in the following claims.

What is claimed is:

1. Apparatus for removing a coating from an elongated metal part comprising:

a soaking vessel containing a soaking solution that includes a degreaser and a composition for softening the coating;

an ultrasonic cleaning vessel containing an aqueous cleaning solution, said ultrasonic cleaning vessel including an elongated steel tank having a generally cylindrical wall and a transducer support that is removably suspended from the cylindrical wall for supporting ultrasonic transducers in said ultrasonic cleaning vessel;

a rinsing vessel containing a first rinsing liquid; and a drying vessel.

2. Apparatus as set forth in claim 1 wherein said ultrasonic cleaning vessel comprises a plurality of ultrasonic transducers disposed in said ultrasonic cleaning vessel for providing insonification of the cleaning solution substantially throughout the volume of said vessel.

3. Apparatus as set forth in claim 2 wherein said ultrasonic transducers comprise electrical cables for conducting electrical energy to said ultrasonic transducers and said transducer support comprises a bracket for supporting said electrical cables such that the cables are not kinked when said transducer support is removed from the ultrasonic cleaning vessel.

4. Apparatus as set forth in claim 2 wherein said transducer support comprises an elongated tubular member having a length that is substantially commensurate with the depth of said elongated steel tank.

5. Apparatus as set forth in claim 4 wherein said ultrasonic transducers are positioned on said elongated tubular member in alternating fashion along the substantially the entire length of said elongated beam.

6. Apparatus as set forth in claim 1 comprising a second rinsing vessel containing a second rinsing liquid and means for placing the elongated metal part in and removing it from said second rinsing vessel.

7. Apparatus as set forth in claim 6 comprising means for heating the soaking solution in said soaking vessel, the aqueous cleaning solution in said ultrasonic cleaning vessel, the first rinsing liquid in said first rinsing vessel, and the second rinsing liquid in said second rinsing vessel to respective predetermined elevated temperatures that are selected to maximize the effectiveness of the respective solutions and liquids.

8. Apparatus as set forth in claim 1 comprising means for heating the soaking solution in said soaking vessel, the aqueous cleaning solution in said ultrasonic cleaning vessel, and the first rinsing liquid in said first rinsing vessel to respective predetermined elevated temperatures that are selected to maximize the effectiveness of the respective solutions and liquid.

9. Apparatus as set forth in claim 1 wherein said drying vessel comprises:

an elongated steel tank having a generally cylindrical wall that is closed at one end and has an opening at the other end thereof for inserting the elongated article into the drying vessel and removing it therefrom;

a removable cover for closing off the opening in the elongated steel tank;

means for heating the elongated article in said drying vessel; and means for rapidly cooling the elongated article in said drying vessel.

10. Apparatus as set forth in claim 9 wherein the means for rapidly cooling the elongated article comprises:

a fan adapted to be disposed over the opening in said steel tank;

an exhaust port formed in the cylindrical wall of the steel tank adjacent the closed end thereof;

a damper disposed over said exhaust port; and means for operating said damper to open or close.

* * * * *